US010341800B2

(12) United States Patent
Chon et al.

(10) Patent No.: US 10,341,800 B2
(45) **Date of Patent: *Jul. 2, 2019**

(54) AUDIO PROVIDING APPARATUS AND AUDIO PROVIDING METHOD

(71) Applicant: SAMSUNG ELECTRONICS CO., LTD., Gyeonggi-do (KR)

(72) Inventors: Sang-bae Chon, Suwon-si (KR); Sun-min Kim, Suwon-si (KR); Jae-ha Park, Suwon-si (KR); Sang-mo Son, Suwon-si (KR); Hyun Jo, Suwon-si (KR); Hyun-joo Chung, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/044,587

(22) Filed: Jul. 25, 2018

(65) Prior Publication Data

US 2018/0359586 A1 Dec. 13, 2018

Related U.S. Application Data

(63) Continuation of application No. 15/685,730, filed on Aug. 24, 2017, which is a continuation of application (Continued)

(51) Int. Cl.
*H04R 5/00* (2006.01)
*H04R 5/02* (2006.01)

(Continued)

(52) U.S. Cl.
CPC ..... *H04S 3/008* (2013.01); *H04S 5/005* (2013.01); *H04S 2400/03* (2013.01); *H04S 2400/11* (2013.01); *H04S 2420/01* (2013.01)

(58) Field of Classification Search
CPC .. H04S 3/008; H04S 2400/01; H04S 2400/03; G10L 19/008

(Continued)

(56) References Cited

U.S. PATENT DOCUMENTS 5,228,085 A 7/1993 Aylward
6,504,934 B1 1/2003 Kasai et al.

(Continued)

FOREIGN PATENT DOCUMENTS

CN 1524399 A 8/2004
CN 101529504 A 9/2009

(Continued)

OTHER PUBLICATIONS

Communication dated Apr. 12, 2018 issued by the Russian Federal Service for Intellectual Property in counterpart Russian Patent Application No. 2017106885.

(Continued)

*Primary Examiner* — Thjuan K Addy
(74) *Attorney, Agent, or Firm* — Sughrue Mion, PLLC

(57) ABSTRACT

An audio providing apparatus and method are provided. The audio providing apparatus includes: an object renderer configured to render an object audio signal based on geometric information regarding the object audio signal; a channel renderer configured to render an audio signal having a first channel number into an audio signal having a second channel number; and a mixer configured to mix the rendered object audio signal with the audio signal having the second channel number.

3 Claims, 15 Drawing Sheets

Related U.S. Application Data

No. 14/649,824, filed as application No. PCT/KR2013/011182 on Dec. 4, 2013, now Pat. No. 9,774,973.

(60) Provisional application No. 61/732,939, filed on Dec. 4, 2012, provisional application No. 61/732,938, filed on Dec. 4, 2012.

(51) Int. Cl.
*H04S 3/00* (2006.01)
*H04S 5/00* (2006.01)

(58) Field of Classification Search
USPC ..... 381/1, 300, 18, 20, 22, 303
See application file for complete search history.

(56) References Cited

U.S. PATENT DOCUMENTS

| | | | |
|---|---|---|---|
| 7,283,634 | B2 | 10/2007 | Smith |
| 8,204,756 | B2 * | 6/2012 | Kim ..... G10L 19/008 381/2 |
| 8,270,616 | B2 | 9/2012 | Slamka et al. |
| 8,325,929 | B2 | 12/2012 | Koppens et al. |
| 8,483,411 | B2 | 7/2013 | Oh et al. |
| 8,560,303 | B2 | 10/2013 | Beack et al. |
| 8,687,829 | B2 | 4/2014 | Hilpert et al. |
| 8,824,688 | B2 | 9/2014 | Schreiner et al. |
| 8,879,742 | B2 | 11/2014 | Disch et al. |
| 9,014,377 | B2 | 4/2015 | Goodwin |
| 9,015,051 | B2 | 4/2015 | Pulkki |
| 9,070,358 | B2 | 6/2015 | Den Brinker et al. |
| 9,099,078 | B2 | 8/2015 | Neusinger et al. |
| 9,161,147 | B2 | 10/2015 | Korn |
| 9,282,417 | B2 | 3/2016 | Harma et al. |
| 9,384,740 | B2 | 7/2016 | Kim et al. |
| 9,426,596 | B2 | 8/2016 | Beack et al. |
| 2007/0270988 | A1 | 11/2007 | Goldstein et al. |
| 2008/0199026 | A1 | 8/2008 | Oh et al. |
| 2009/0083045 | A1 | 3/2009 | Briand et al. |
| 2009/0144063 | A1 | 6/2009 | Beack et al. |
| 2009/0225991 | A1 | 9/2009 | Oh et al. |
| 2009/0248423 | A1 | 10/2009 | Jung et al. |
| 2010/0014692 | A1 | 1/2010 | Schreiner et al. |
| 2010/0226498 | A1 | 9/2010 | Kino et al. |
| 2010/0324915 | A1 | 12/2010 | Seo et al. |
| 2011/0013790 | A1 | 1/2011 | Hilpert et al. |
| 2011/0087494 | A1 | 4/2011 | Kim et al. |
| 2011/0150227 | A1 | 6/2011 | Kim |
| 2011/0200196 | A1 | 8/2011 | Disch et al. |
| 2011/0264456 | A1 | 10/2011 | Koppens et al. |
| 2012/0008789 | A1 | 1/2012 | Kim et al. |
| 2012/0093323 | A1 | 4/2012 | Lee et al. |
| 2012/0134501 | A1 | 5/2012 | Choo et al. |
| 2012/0155650 | A1 | 6/2012 | Horbach |
| 2012/0170756 | A1 | 7/2012 | Kraemer et al. |
| 2012/0294449 | A1 | 11/2012 | Beack et al. |
| 2012/0328109 | A1 | 12/2012 | Harma et al. |
| 2013/0094672 | A1 | 4/2013 | Liang |
| 2014/0161261 | A1 | 6/2014 | Oh et al. |
| 2014/0177848 | A1 | 6/2014 | Oh et al. |
| 2014/0222439 | A1 | 8/2014 | Jung et al. |
| 2016/0044431 | A1 | 2/2016 | Kraemer et al. |
| 2017/0084285 | A1 | 3/2017 | Engdegard et al. |
| 2017/0358308 | A1 | 12/2017 | Furse |

FOREIGN PATENT DOCUMENTS

| | | | |
|---|---|---|---|
| CN | 101669167 | A | 3/2010 |
| CN | 101826356 | A | 9/2010 |
| CN | 101911732 | A | 12/2010 |
| CN | 101036414 | B | 9/2011 |
| CN | 102187691 | A | 9/2011 |
| CN | 102239520 | A | 11/2011 |
| CN | 102270456 | A | 12/2011 |
| CN | 102318372 | A | 1/2012 |
| CN | 102428513 | A | 4/2012 |
| CN | 102598122 | A | 7/2012 |
| CN | 102726066 | A | 10/2012 |
| EP | 2 111 616 | A1 | 10/2009 |
| EP | 2 111 616 | B1 | 9/2011 |
| EP | 2 082 397 | B1 | 12/2011 |
| EP | 2 560 160 | B1 | 12/2013 |
| JP | 7222299 | A | 8/1995 |
| JP | 11220800 | A | 8/1999 |
| JP | 2006163532 | A | 6/2006 |
| JP | 2008-509600 | A | 3/2008 |
| JP | 2011-509429 | A | 3/2011 |
| JP | 2011-193164 | A | 9/2011 |
| JP | 2011528200 | A | 11/2011 |
| JP | 201234295 | A | 2/2012 |
| JP | 201268666 | A | 4/2012 |
| JP | 2012516596 | A | 7/2012 |
| JP | 2013533703 | A | 8/2013 |
| JP | 2014505427 | A | 2/2014 |
| KR | 1020070079945 | A | 8/2007 |
| KR | 1020080094775 | A | 10/2008 |
| KR | 1020090022464 | A | 3/2009 |
| KR | 1020090053958 | A | 5/2009 |
| KR | 1020090057131 | A | 6/2009 |
| KR | 1020110072923 | A | 6/2011 |
| KR | 1020120038891 | A | 4/2012 |
| RU | 2430430 | C2 | 9/2011 |
| RU | 2 431 940 | C2 | 10/2011 |
| WO | 2007091870 | A1 | 8/2007 |
| WO | 2008046530 | A2 | 4/2008 |
| WO | 2008/078973 | A1 | 7/2008 |
| WO | 2008/100099 | A1 | 8/2008 |
| WO | 2011095913 | A1 | 8/2011 |
| WO | 2012005507 | A2 | 1/2012 |
| WO | 2012094335 | A1 | 7/2012 |
| WO | 2013006338 | A2 | 1/2013 |
| WO | 20140159272 | A1 | 10/2014 |

OTHER PUBLICATIONS

Communication dated Jan. 12, 2018, issued by the Australian IP Office in counterpart Australian Patent Application No. 2016238969.

Communication dated Aug. 22, 2017 by the Korean Intellectual Property Office in counterpart Korean Patent Application No. 10-2015-7018083.

Communication dated Aug. 16, 2016 issued by the European Patent Office in counterpart European Patent Application No. 13861015.9.

Communication dated Jan. 11, 2017 issued by The State Intellectual Property Office of P.R. China in counterpart Chinese Patent Application No. 201380072141.8.

Communication dated Jul. 22, 2016 issued by the Russian Patent Office in counterpart Russian Patent Application No. 2015126777.

Communication dated Jun. 2, 2016, issued by the State Intellectual Property Office of P.R. China in counterpart Chinese Application No. 201380072141.8.

Communication dated Mar. 21, 2016, issued by the Korean Intellectual Property Office in counterpart Korean Application No. 10-2015-7018083.

Communication dated May 24, 2016, issued by the Japanese Patent Office in counterpart Japanese Application No. 2015-546386.

Communication dated May 26, 2016, issued by the Mexican Patent Office in counterpart Mexican Application No. MX/a/2015/007100.

Communication dated Oct. 12, 2016, issued by the Canadian Intellectual Property Office in counterpart Canadian Application No. 2,893,729.

Communication dated Sep. 23, 2016 issued by the Mexican Patent Office in counterpart Mexican Patent Application No. MX/a/2015007100.

Communication dated Apr. 7, 2014 by the International Searching Authority in related Application No. PCT/KR2013/011182.

Communication dated Apr. 7, 2015 by the International Searching Authority in related Application No. PCT/KR2013/011182.

(56) References Cited

OTHER PUBLICATIONS

Office Action (Patent Examination Report) dated Oct. 22, 2015, issued by the Australian Patent Office in counterpart Australian Application No. 2013355504.
Office Action issued in U.S. Appl. No. 14/649,824 dated Jun. 24, 2016.
Notice of Allowance issued in U.S. Appl. No. 14/649,824 dated Dec. 16, 2016.
Notice of Allowance issued in U.S. Appl. No. 14/649,824 dated May 31, 2017.
Notice of Allowance issued in U.S. Appl. No. 15/685,730 dated Jul. 25, 2018.
Communication dated Jul. 31, 2018, issued by the Japanese Patent Office in counterpart Japanese Patent Application No. 2017-126130.
Communication dated Sep. 14, 2018, issued by the Intellectual Property Corporation of Malaysia in counterpart Malaysian Patent Application No. PI 2015701775.
Communication dated Oct. 23, 2018, issued by the Indonesian Patent Office in the counterpart Indonesian Application No. P00201504108.
Communication dated Jan. 4, 2019, issued by the State Intellectual Property Office of P.R. China in counterpart Chinese Application No. 201710950921.8.
Communication dated Jan. 22, 2019 issued by the Korean Intellectual Property Office in counterpart Koran Patent Application No. 10-2017-07033842.
Communication dated Jan. 29, 2019 issued by the Japanese Patent Office in counterpart Japanese Patent Application No. 2017-126130.
Communication dated Mar. 22, 2019 issued by the Intellectual Property Office of India in counterpart Indian Patent Application No. 1771/MUMNP/2015.

* cited by examiner

AUDIO PROVIDING APPARATUS AND AUDIO PROVIDING METHOD

CROSS-REFERENCE TO RELATED APPLICATIONS

This is a continuation of U.S. application Ser. No. 15/685,730 filed on Aug. 24, 2017, which is a continuation of U.S. application Ser. No. 14/649,824 filed on Jun. 4, 2015 and issued as U.S. Pat. No. 9,774,973 on Sep. 26, 2017, which is a National Stage application under 35 U.S.C. § 371 of PCT/KR2013/011182, filed on Dec. 4, 2013, which claims the benefit of U.S. Provisional Application No. 61/732,938, filed on Dec. 4, 2012 in the United States Patent and Trademark Office, and U.S. Provisional Application No. 61/732,939, filed on Dec. 4, 2012 in the United States Patent and Trademark Office, all the disclosures of which are incorporated herein in their entireties by reference.

BACKGROUND

1. Field

Apparatuses and methods consistent with exemplary embodiments relate to an audio providing apparatus and method, and more particularly, to an audio providing apparatus and method that render and output audio signals having various formats to be optimal for an audio reproduction system.

2. Description of the Related Art

At present, various audio formats are being used in the multimedia market. For example, an audio providing apparatus provides various audio formats from a two-channel audio format to a 22.2-channel audio format. In particular, an audio system may use channels such as 7.1 channel, 11.1 channel, and 22.2 channel for expressing a sound source in a three-dimensional space.

However, most audio signals have a 2.1-channel format or a 5.1-channel format and have a limitation in expressing a sound source in a three-dimensional space. Also, it is difficult to setup, in homes, an audio system for reproducing 7.1-channel, 11.1-channel, and 22.2-channel audio signals.

Therefore, there is a need for a method of actively rendering an audio signal according to a format of an input signal and an audio reproducing system.

SUMMARY

Aspects of one or more exemplary embodiments provide an audio providing method and an audio providing apparatus using the method, which optimize a channel audio signal for a listening environment by up-mixing or down-mixing the channel audio signal and which render an object audio signal according to geometric information to provide a sound image optimized for the listening environment.

According to an aspect of an exemplary embodiment, there is provided an audio providing apparatus including: an object renderer configured to render an object audio signal based on geometric information regarding the object audio signal; a channel renderer configured to render an audio signal having a first channel number into an audio signal having a second channel number; and a mixer configured to mix the rendered object audio signal with the audio signal having the second channel number.

The object renderer may include: a geometric information analyzer configured to convert the geometric information regarding the object audio signal into three-dimensional (3D) coordinate information; a distance controller configured to generate distance control information, based on the 3D coordinate information; a depth controller configured to generate depth control information, based on the 3D coordinate information; a localizer configured to generate localization information for localizing the object audio signal, based on the 3D coordinate information; and a renderer configured to render the object audio signal, based on the generated distance control information, the generated depth control information, and the generated localization information.

The distance controller may be configured to: acquire a distance gain of the object audio signal; as a distance of the object audio signal increases, decrease the distance gain of the object audio signal; and as the distance of the object audio signal decreases, increase the distance gain of the object audio signal.

The depth controller may be configured to acquire a depth gain, based on a horizontal projection distance of the object audio signal; and the depth gain is expressed as a sum of a negative vector and a positive vector or is expressed as a sum of the negative vector and a null vector.

The localizer may be configured to acquire a panning gain for localizing the object audio signal according to a speaker layout of the audio providing apparatus.

The renderer may be configured to render the object audio signal into a multi-channel signal, based on the acquired depth gain, the acquired panning gain, and the acquired distance gain of the object audio signal.

The object renderer may be configured to, when a plurality of object audio signals is received, acquire a phase difference between object audio signals having a correlation among the received plurality of object audio signals and to move one of the plurality of object audio signals by the acquired phase difference to combine the plurality of object audio signals.

The object renderer may include: a virtual filter configured to correct spectral characteristics of the object audio signal and to add virtual elevation information to the object audio signal, when the audio providing apparatus reproduces audio using a plurality of speakers having a same elevation; and a virtual renderer configured to render the object audio signal, based on the virtual elevation information supplied by the virtual filter.

The virtual filter may have a tree structure including a plurality of stages.

The channel renderer may be configured to, when a layout of the audio signal having the first channel number is a two-dimensional (2D) layout, up-mix the audio signal having the first channel number to the audio signal having the second channel number greater than the first channel number; and a layout of the audio signal having the second channel number may be a 3D layout having elevation information that differs from elevation information regarding the audio signal having the first channel number.

The channel renderer may be configured to, when a layout of the audio signal having the first channel number is a 3D layout, down-mix the audio signal having the first channel number to the audio signal having the second channel number less than the first channel number; and a layout of the audio signal having the second channel number may be a 2D layout where a plurality of channels have a same elevation component.

At least one of the object audio signal and the audio signal having the first channel number may include information for determining whether to perform virtual 3D rendering on a specific frame.

The channel renderer may be configured to acquire a phase difference between a plurality of audio signals having a correlation in an operation of rendering the audio signal having the first channel number into the audio signal having the second channel number, and to move one of the plurality of audio signals by the acquired phase difference to combine the plurality of audio signals.

The mixer may be configured to acquire a phase difference between a plurality of audio signals having a correlation while mixing the rendered object audio signal with the audio signal having the second channel number, and to move one of the plurality of audio signals by the acquired phase difference to combine the plurality of audio signals.

The object audio signal may include at least one of an identification (ID) and type information regarding the object audio signal for enabling a user to select the object audio signal.

According to an aspect of another exemplary embodiment, there is provided an audio providing method including: rendering an object audio signal based on geometric information regarding the object audio signal; rendering an audio signal having a first channel number into an audio signal having a second channel number; and mixing the rendered object audio signal with the audio signal having the second channel number.

The rendering the object audio signal may include: converting the geometric information regarding the object audio signal into three-dimensional (3D) coordinate information; generating distance control information, based on the 3D coordinate information; generating depth control information, based on the 3D coordinate information; generating localization information for localizing the object audio signal, based on the 3D coordinate information; and rendering the object audio signal, based on the generated distance control information, the generated depth control information, and the generated localization information.

The generating the distance control information may include: acquiring a distance gain of the object audio signal; decreasing the distance gain of the object audio signal as a distance of the object audio signal increases; and increasing the distance gain of the object audio signal as the distance of the object audio signal decreases.

The generating the depth control information may include acquiring a depth gain, based on a horizontal projection distance of the object audio signal; and the depth gain may be expressed as a sum of a negative vector and a positive vector or is expressed as a sum of the negative vector and a null vector.

The generating the localization information may include acquiring a panning gain for localizing the object audio signal according to a speaker layout of an audio providing apparatus.

The rendering the object audio signal based on the generated distance control information, the generated depth control information, and the generated localization information may include rendering the object audio signal to a multi-channel signal, based on the acquired depth gain, the acquired panning gain, and the acquired distance gain of the object audio signal.

The rendering the object audio signal may include, when a plurality of object audio signals is received: acquiring a phase difference between object audio signals having a correlation among the received plurality of object audio signals; and moving one of the plurality of object audio signals by the acquired phase difference to combine the plurality of object audio signals.

The rendering the object audio signal may include, when an audio providing apparatus reproduces audio by using a plurality of speakers having a same elevation: correcting spectral characteristics of the object audio signal and adding virtual elevation information to the object audio signal; and rendering the object audio signal, based on the virtual elevation information supplied by the correcting.

The virtual elevation information may be added to the object audio signal by using a virtual filter which has a tree structure including a plurality of stages.

The rendering the audio signal having the first channel number into the audio signal having the second channel number may include, when a layout of the audio signal having the first channel number is a two-dimensional (2D) layout, up-mixing the audio signal having the first channel number to the audio signal having the second channel number greater than the first channel number; and a layout of the audio signal having the second channel number may be a 3D layout having elevation information that differs from elevation information regarding the audio signal having the first channel number.

The rendering the audio signal having the first channel number to the audio signal having the second channel number may include, when a layout of the audio signal having the first channel number is a 3D layout, down-mixing the audio signal having the first channel number to the audio signal having the second channel number less than the first channel number; and a layout of the audio signal having the second channel number may be a 2D layout where a plurality of channels have a same elevation component.

At least one of the object audio signal and the audio signal having the first channel number may include information for determining whether to perform virtual 3D rendering on a specific frame.

According to an aspect of another exemplary embodiment, there is provided an audio providing apparatus including: a de-multiplexer configured to demultiplex an audio signal into an object audio signal and a channel audio signal; an object renderer configured to render an object audio signal based on geometric information regarding the object audio signal; and a mixer configured to mix the rendered object audio signal with the channel audio signal.

The audio providing apparatus may further include: a channel renderer configured to render the channel audio signal having a first channel number into a channel audio signal having a second channel number, wherein the mixer may be configured to mix the rendered object audio signal with the channel audio signal having the second channel number.

The object renderer may include: a geometric information analyzer configured to convert the geometric information regarding the object audio signal into three-dimensional (3D) coordinate information; a distance controller configured to generate distance control information, based on the 3D coordinate information; a depth controller configured to generate depth control information, based on the 3D coordinate information; a localizer configured to generate localization information for localizing the object audio signal, based on the 3D coordinate information; and a renderer configured to render the object audio signal, based on the generated distance control information, the generated depth control information, and the generated localization information.

The distance controller may be configured to: acquire a distance gain of the object audio signal; as a distance of the object audio signal increases, decrease the distance gain of the object audio signal; and as the distance of the object audio signal decreases, increase the distance gain of the object audio signal.

The depth controller may be configured to acquire a depth gain, based on a horizontal projection distance of the object audio signal; and the depth gain may be expressed as a sum of a negative vector and a positive vector or is expressed as a sum of the negative vector and a null vector.

The localizer may be configured to acquire a panning gain for localizing the object audio signal according to a speaker layout of the audio providing apparatus.

The renderer may be configured to render the object audio signal into a multi-channel signal, based on the acquired depth gain, the acquired panning gain, and the acquired distance gain of the object audio signal.

The object renderer may be configured to, when a plurality of object audio signals is received, acquire a phase difference between object audio signals having a correlation among the received plurality of object audio signals and to move one of the plurality of object audio signals by the acquired phase difference to combine the plurality of object audio signals.

According to an aspect of another exemplary embodiment, there is provided a non-transitory computer readable recording medium having recorded thereon a program executable by a computer for performing the above method.

According to aspects of one or more exemplary embodiments, an audio providing apparatus may reproduce audio signals having various formats to be optimal for an output audio system.

DETAILED DESCRIPTION OF EXEMPLARY EMBODIMENTS

Figure 1:
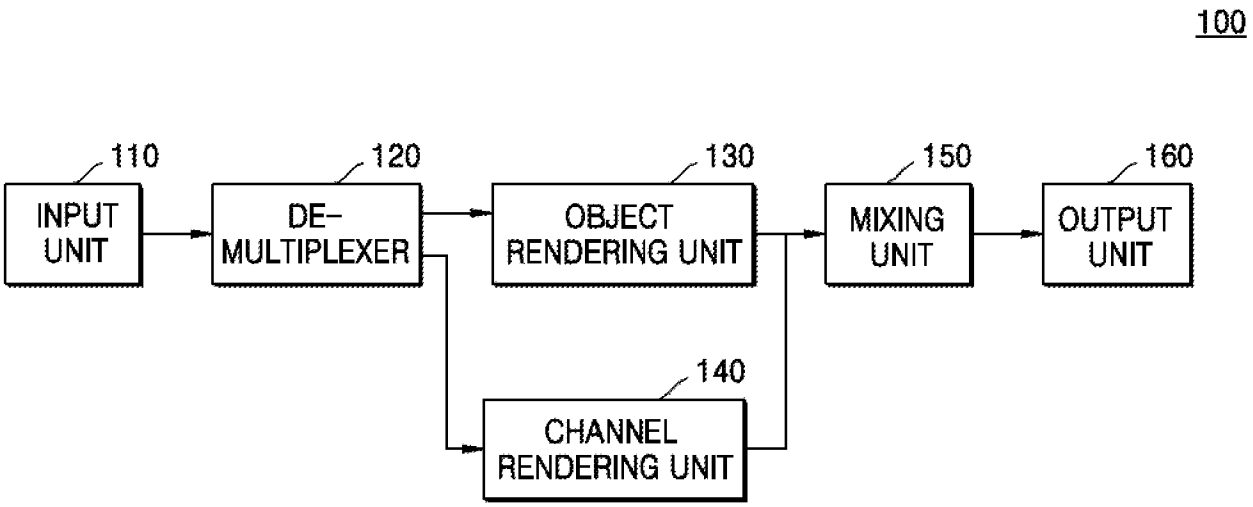
FIG. 1 is a block diagram illustrating a configuration of an audio providing apparatus according to an exemplary embodiment.

Hereinafter, one or more exemplary embodiments will be described in detail with reference to the accompanying drawings. As the present inventive concept allows for various modifications and numerous exemplary embodiments, particular exemplary embodiments will be illustrated in the drawings and described in detail in the written description. However, this is not intended to limit exemplary embodiments to particular modes of practice, and it is to be appreciated that all changes, equivalents, and substitutes that do not depart from the spirit and technical scope of the present inventive concept are encompassed. Hereinafter, it is understood that expressions such as "at least one of," when preceding a list of elements, modify the entire list of elements and do not modify the individual elements of the list.

FIG. 1 is a block diagram illustrating a configuration of an audio providing apparatus 100 according to an exemplary embodiment. As illustrated in FIG. 1, the audio providing apparatus 100 includes an input unit 110 (e.g., inputter or input device), a de-multiplexer 120, an object rendering unit 130 (e.g., object renderer), a channel rendering unit 140 (e.g., renderer), a mixing unit 150 (e.g., mixer), and an output unit 160 (e.g., outputter or output device).

The input unit 110 may receive an audio signal from various sources. In this case, an audio source may include or provide a channel audio signal and an object audio signal. Here, the channel audio signal is an audio signal including a background sound of a corresponding frame and may have a first channel number (for example, 5.1 channel, 7.1 channel, etc.). Also, the object audio signal may be an object having a motion or an audio signal of an important object in a corresponding frame. Examples of the object audio signal may include voice, gunfire, etc. The object audio signal may include geometric information of the object audio signal.

The de-multiplexer 120 may de-multiplex the channel audio signal and the object audio signal from the received audio signal. Furthermore, the de-multiplexer 120 may respectively output the de-multiplexed object audio signal and channel audio signal to the object rendering unit 130 and the channel rendering unit 140.

The object rendering unit 130 may render the received object audio signal, based on geometric information regarding the received object audio signal. In this case, the object audio rendering unit 130 may render the received object audio signal according to a speaker layout of the audio providing apparatus 100. For example, when the speaker layout of the audio providing apparatus 100 is a two-dimensional (2D) layout having the same elevation, the object rendering unit 130 may two-dimensionally render the received object audio signal. Also, when the speaker layout of the audio providing apparatus 100 is a three-dimensional (3D) layout having a plurality of elevations, the object rendering unit 130 may three-dimensionally render the received object audio signal. Furthermore, in the case that the speaker layout of the audio providing apparatus 100 is the 2D layout having the same elevation, the object rendering unit 130 may add virtual elevation information to the received object audio signal and three-dimensionally render the object audio signal. The object rendering unit 130 will be described in detail with reference to FIGS. 2 to 4, 5A and 5B, 6, and 7A and 7B.

Figure 2:
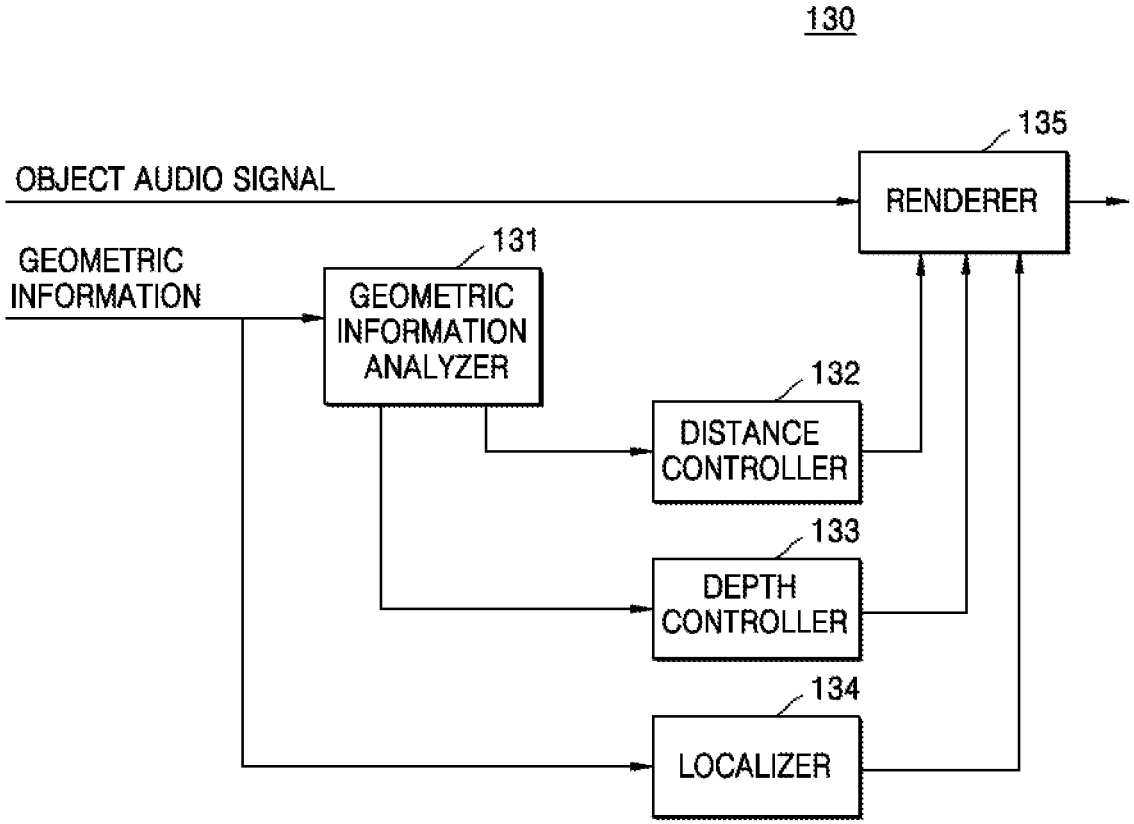
FIG. 2 is a block diagram illustrating a configuration of an object rendering unit according to an exemplary embodiment.

FIG. 2 is a block diagram illustrating a configuration of the object rendering unit 130 according to an exemplary embodiment. As illustrated in FIG. 2, the object rendering unit 130 may include a geometric information analyzer 131, a distance controller 132, a depth controller 133, a localizer 134, and a renderer 135.

Figure 3:
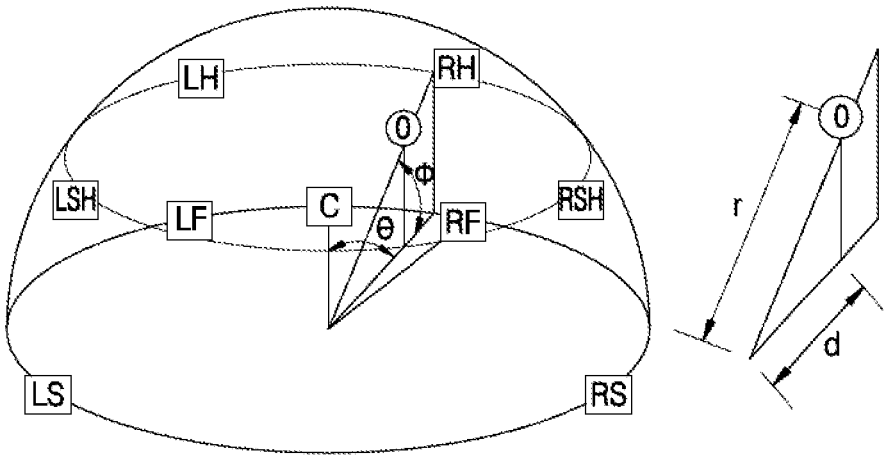
FIG. 3 is a diagram for describing geometric information of an object audio signal according to an exemplary embodiment.

The geometric information analyzer 131 may receive and analyze geometric information regarding an object audio signal. In detail, the geometric information analyzer 131 may convert the geometric information regarding the object audio signal into 3D coordinate information used for rendering. For example, as illustrated in FIG. 3, the geometric information analyzer 131 may analyze the received object audio signal "O" into coordinate information (r, Θ, φ). Here, r denotes a distance between a position of a listener and the object audio signal, Θ denotes an azimuth angle of a sound image, and φ denotes an elevation angle of the sound image.

The distance controller 132 may generate distance control information, based on the 3D coordinate information. In detail, the distance controller 132 may calculate a distance gain of the object audio signal, based on a 3D distance "r" obtained through analysis by the geometric information analyzer 131. In this case, the distance controller 132 may calculate the distance gain in inverse proportion to the 3D distance "r". That is, as a distance of the object audio signal increases, the distance controller 132 may decrease the distance gain of the object audio signal, and as the distance of the object audio signal decreases, the distance controller 132 may increase the distance gain of the object audio signal. Also, when a position is closer to the origin point, the distance controller 132 may set an upper limit gain value that is not of purely inverse proportion, in order for the distance gain not to diverge. For example, the distance controller 132 may calculate the distance gain "$d_g$" as expressed in the following Equation (1):

$$d_g = \frac{1}{(0.3 + 0.7r)} \tag{1}$$

Figure 4:
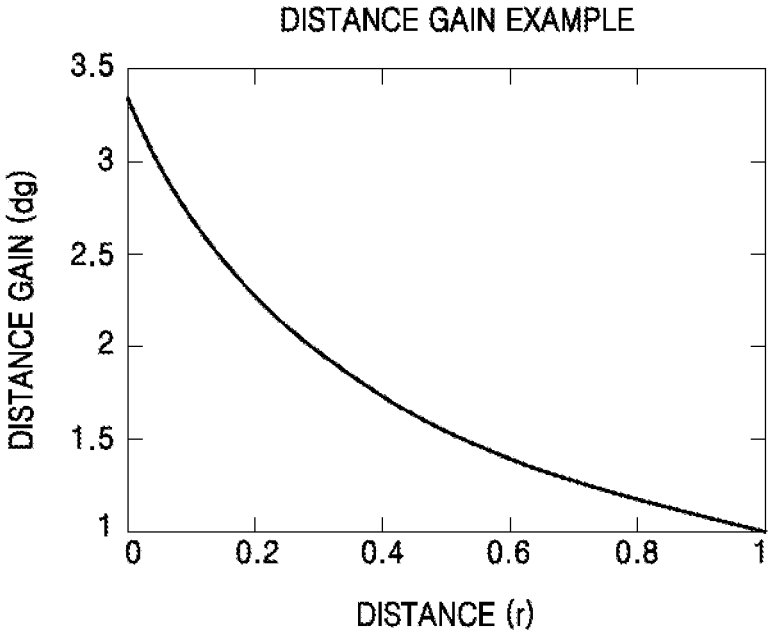
FIG. 4 is a graph for describing a distance gain based on distance information of an object audio signal according to an exemplary embodiment.

That is, as illustrated in FIG. 4, the distance controller 132 may set the distance gain value "$d_g$" to 1 to 3.3, based on Equation (1).

The depth controller 133 may generate depth control information, based on the 3D coordinate information. In this case, the depth controller 133 may acquire a depth gain, based on a horizontal projection distance "d" of the object audio signal and the position of the listener.

In this case, the depth controller 133 may express the depth gain as a sum of a negative vector and a positive vector. In detail, when r<1 in 3D coordinates of the object audio signal, namely, when the object audio signal is located in a sphere consisting of a speaker included in the audio providing apparatus 100, the positive vector is defined as (r, Θ, φ), and the negative vector is defined as (r, Θ+180, φ). In order to define the object audio signal, the depth controller 133 may calculate a depth gain "$v_p$" of the positive vector and a depth gain "$v_n$" of the negative vector for expressing a geometric vector of the object audio signal as a sum of the positive vector and the negative vector. In this case, the depth gain "$v_p$" of the positive vector and the depth gain "$v_n$" of the negative vector may be calculated as expressed in the following Equation (2):

$$v_p = \sin(dS\pi/2 + \pi/4)$$

$$v_n = \cos(dS\pi/2 + \pi/4) \tag{2}$$

Figure 5A:
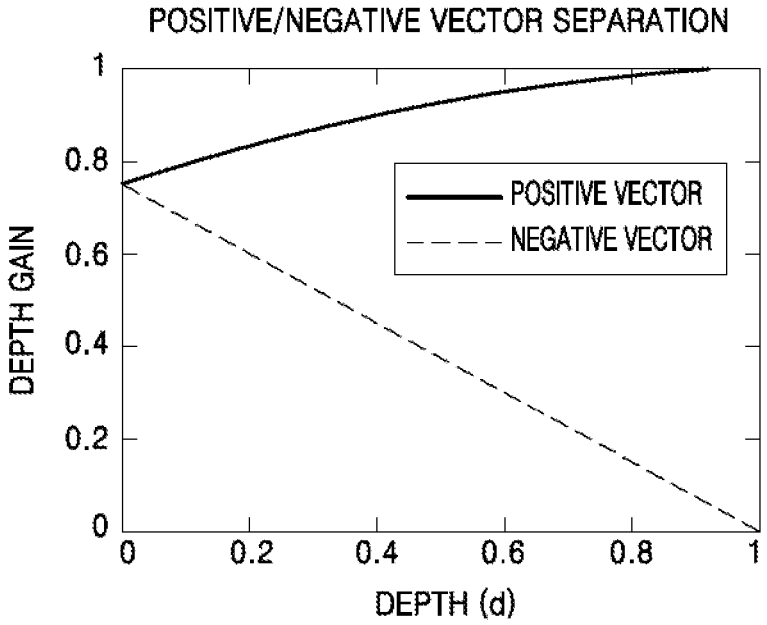
FIGS. 5A and 5B are graphs for describing a depth gain based on depth information of an object audio signal according to an exemplary embodiment.

That is, as illustrated in FIG. 5A, the depth controller 133 may calculate the depth gain of the positive vector and the depth gain of the negative vector where the horizontal projection distance "d" is 0 to 1.

Moreover, the depth controller 133 may express the depth gain as a sum of the positive vector and the negative vector. In detail, a panning gain when there is no direction where a sum of multiplications of panning gains and positions of all channels converges to 0 may be defined as a null vector. Particularly, the depth controller 133 may calculate the depth gain "$v_p$" of the positive vector and a depth gain "$v_{nll}$" of the null vector so that when the horizontal projection distance "d" is close to 0, the depth gain of the null vector is mapped to 1, and when the horizontal projection distance "d" is close to 1, the depth gain of the positive vector is mapped to 1. In this case, the depth gain "$v_p$" of the positive vector and the depth gain "$v_{nll}$" of the null vector may be calculated as expressed in the following Equation (3):

$$v_p = \sin(dS\pi/2)$$

$$v_{nll} = \sin(dS\pi/2) \tag{3}$$

Figure 5B:
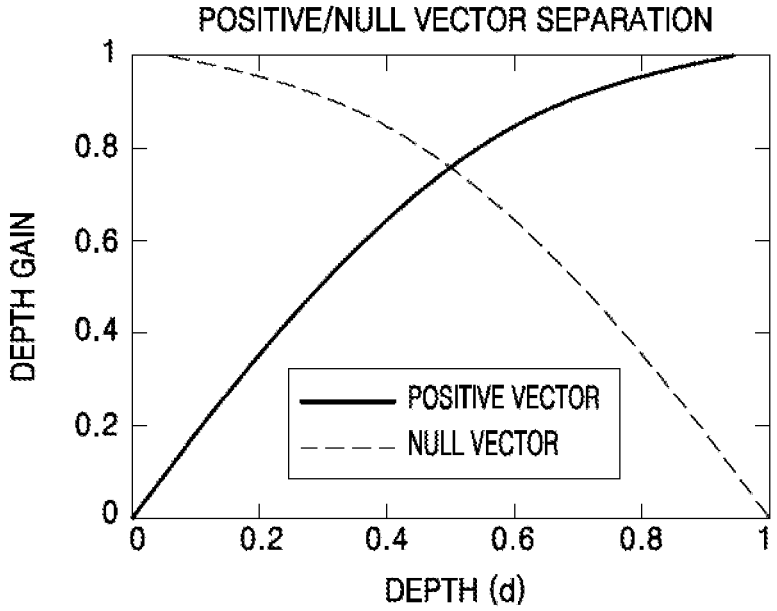

That is, as illustrated in FIG. 5B, the depth controller 133 may calculate the depth gain of the positive vector and the depth gain of the null vector where the horizontal projection distance "d" is 0 to 1.

Depth control is performed by the depth controller 133, and when the horizontal projection distance is close to 0, a sound may be output through all speakers. Therefore, a discontinuity that occurs in a panning boundary is reduced.

The localizer 134 may generate localization information for localizing the object audio signal, based on the 3D coordinate information. In particular, the localizer 134 may calculate a panning gain for localizing the object audio signal according to the speaker layout of the audio providing apparatus 100. In detail, the localizer 134 may select a triplet speaker for localizing the positive vector having the same direction as that of a geometry of the object audio signal and calculate a 3D panning coefficient "$g_p$" for the triplet speaker of the positive vector. Also, when the depth controller 133 expresses a depth gain with the positive vector and the negative vector, the localizer 134 may select a triplet speaker for localizing the negative vector having a direction opposite to a direction of the trajectory of the object audio signal and calculate a 3D panning coefficient "$g_n$" for the triplet speaker of the negative vector.

The renderer 135 may render the object audio signal, based on the distance control information, the depth control information, and the localization information. Particularly, the renderer 135 may receive the distance gain "$d_g$" from the distance controller 132, receive a depth gain "v" from the depth controller 133, receive a panning gain "g" from the localizer 134, and apply the distance gain "$d_g$", the depth gain "v", and the panning gain "g" to the object audio signal to generate a multi-channel object audio signal. In particular, when the depth gain of the object audio signal is expressed as a sum of the positive vector and the negative vector, the renderer 135 may calculate an mth-channel final gain "Gm" as expressed in the following Equation (4):

$$G_m = d_g S(g_{p,m} S v_p + g_{n,m} S v_n) \tag{4}$$

where $g_{p,m}$ denotes a panning coefficient applied to an m channel when the positive vector is localized, and $g_{n,m}$ denotes a panning coefficient applied to the m channel when the negative vector is localized.

Moreover, when the depth gain of the object audio signal is expressed as a sum of the positive vector and the null vector, the renderer 135 may calculate the mth-channel final gain "Gm" as expressed in the following Equation (5):

$$G_m = d_g S(g_{p,m} S v_p + g_{nll,m} S v_{nll} \quad (5)$$

where $g_{p,m}$ denotes a panning coefficient applied to an m channel when the positive vector is localized, and $g_{n,m}$ denotes a panning coefficient applied to the m channel when the negative vector is localized. Furthermore, $\Sigma g_{nll,m}$ may become 0.

Moreover, the renderer 135 may apply the final gain to the object audio signal "x" to calculate a final output "$Y_m$" of an mth-channel object audio signal as expressed in the following Equation (6):

$$Y_m X s G_m \quad (6)$$

The final output "$Y_m$" of the object audio signal calculated as described above may be output to the mixing unit 150.

Moreover, when there are a plurality of object audio signals, the object rendering unit 130 may calculate a phase difference between the plurality of object audio signals and move at least one of the plurality of object audio signals by the calculated phase difference to combine the plurality of object audio signals.

In detail, in a case where a plurality of object audio signals are the same signals but have opposite phases while the plurality of object audio signals are being input, when the plurality of object audio signals are combined as-is, an audio signal is distorted due to overlapping of the plurality of object audio signals. Therefore, the object rendering unit 130 may calculate a correlation between the plurality of object audio signals, and when the correlation is equal to or greater than a predetermined value, the object rendering unit 130 may calculate a phase difference between the plurality of object audio signals and move at least one of the plurality of object audio signals by the calculated phase difference to combine the plurality of object audio signals. Accordingly, when a plurality of object audio signals similar thereto are input, distortion caused by combination of the plurality of object audio signals is prevented.

In the above-described exemplary embodiment, the speaker layout of the audio providing apparatus 100 is the 3D layout having different senses of elevation. However, it is understood that one or more other exemplary embodiments are not limited thereto. The speaker layout of the audio providing apparatus 100 may be a 2D layout having the same value of elevation. Particularly, when the speaker layout of the audio providing apparatus 100 is the 2D layout having the same sense of elevation, the object rendering unit 130 may set a value of φ, included in the above-described geometric information regarding the object audio signal, to 0.

Moreover, the speaker layout of the audio providing apparatus 100 may be the 2D layout having the same sense of elevation, but the audio providing apparatus 100 may virtually provide a 3D object audio signal using the 2D speaker layout.

Hereinafter, an exemplary embodiment for providing a virtual 3D object audio signal will be described with reference to FIGS. 6, 7A, and 7B.

Figure 6:
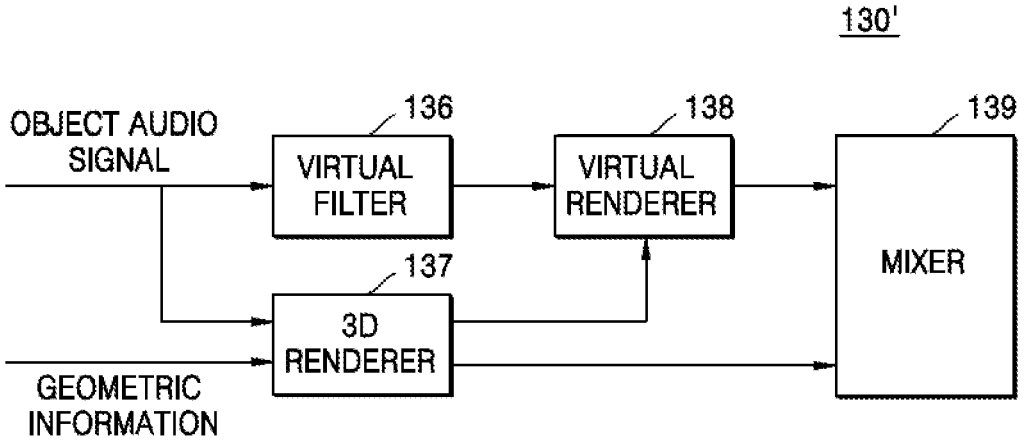
FIG. 6 is a block diagram illustrating a configuration of an object rendering unit for providing a virtual three-dimensional (3D) object audio signal, according to another exemplary embodiment.
Figure 7A:
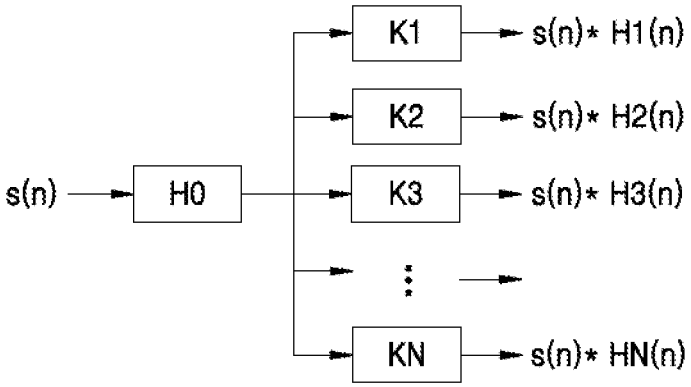
FIGS. 7A and 7B are diagrams for describing a virtual filter according to an exemplary embodiment.
Figure 7B:
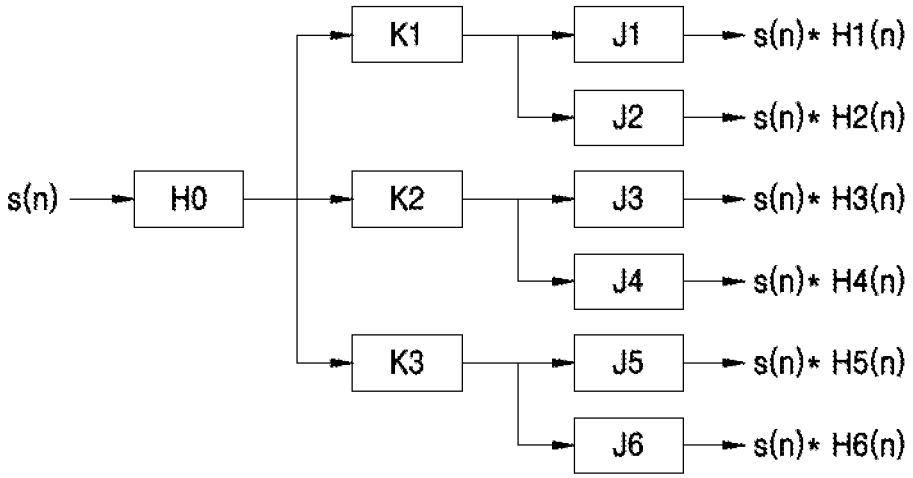

FIG. 6 is a block diagram illustrating a configuration of an object rendering unit 130' for providing a virtual 3D object audio signal, according to another exemplary embodiment. As illustrated in FIG. 6, the object rendering unit 130' includes a virtual filter 136, a 3D renderer 137, a virtual renderer 138, and a mixer 139.

The 3D renderer 137 may render an object audio signal by using the method described above with reference to FIGS. 2 to 4 and 5A and 5B. In this case, the 3D renderer 137 may output the object audio signal, which is capable of being output through a physical speaker of the audio providing apparatus 100, to the mixer 139 and output a virtual panning gain "$g_{m,top}$" of a virtual speaker providing different senses of elevation.

The virtual filter 136 is a block that compensates a tone color of an object audio signal. The virtual filter 136 may compensate spectral characteristics of an input object audio signal based on psychoacoustics and provide a sound image to a position of the virtual speaker. In this case, the virtual filter 136 may be implemented as filters of various types such as a head-related transfer function (HRTF) filter, a binaural room impulse response (BRIR) filter, etc.

Moreover, when the length of the virtual filter 136 is less than that of a frame, the virtual filter 136 may be applied through block convolution.

Moreover, when rendering is performed in a frequency domain such as a fast Fourier transform (FFT), a modified discrete cosine transform (MDCT), and a quadrature mirror filter (QMF), the virtual filter 136 may be applied as multiplication.

When a plurality of virtual top layer speakers are provided, the virtual filter 136 may generate the plurality of virtual top layer speakers by using a distribution formula of physical speakers and one elevation filter.

Moreover, when a plurality of virtual top layer speakers and a virtual back speaker are provided, the virtual filter 136 may generate the plurality of virtual top layer speakers and the virtual back speaker by using a distribution formula of physical speakers and a plurality of virtual filters, for applying a spectral coloration at different positions.

Moreover, if N number of spectral colorations such as H1, H2, . . . , HN are used, the virtual filter 136 may be designed in a tree structure so as to reduce the number of arithmetic operations. In detail, as illustrated in FIG. 7A, the virtual filter 136 may design a notch/peak, which is used to recognize a height in common, to H0 and connect K1 to KN to H0 in a cascade type. Here, K1 to KN are components obtained by subtracting a characteristic of H0 from H1 to HN. Also, the virtual filter 136 may have a tree structure including a plurality of stages illustrated in FIG. 7B, based on a common component and spectral coloration.

The virtual renderer 138 is a rendering block for expressing a virtual channel as a physical channel. Particularly, the virtual renderer 138 may generate an object audio signal that is output to the virtual speaker according to a virtual channel distribution formula output from the virtual filter 136 and multiply the generated object audio signal of the virtual speaker by the virtual panning gain "$g_{m,top}$" to combine output signals. In this case, a position of the virtual speaker may be changed according to a degree of distribution to a plurality of physical flat cone speakers, and the degree of distribution may be defined as the virtual channel distribution formula.

The mixer 139 may mix a physical-channel object audio signal with a virtual-channel object audio signal.

Therefore, an object audio signal may be expressed as being located on a 3D layout by using the audio providing apparatus 100 having a 2D speaker layout.

Referring again to FIG. 1, the channel rendering unit 140 may render a channel audio signal having a first channel number into an audio signal having a second channel number. In this case, the channel rendering unit 140 may change the channel audio signal having the first channel number to the audio signal having the second channel number, based on a speaker layout.

In detail, when a layout of a channel audio signal is the same as a speaker layout of the audio providing apparatus 100, the channel rendering unit 140 may render the channel audio signal without changing a channel.

Moreover, when the number of channels of the channel audio signal is more than the number of channels of the speaker layout of the audio providing apparatus 100, the channel rendering unit 140 may down-mix the channel audio signal to perform rendering. For example, when a channel of the channel audio signal is 7.1 channel and the speaker layout of the audio providing apparatus 100 is 5.1 channel, the channel rendering unit 140 may down-mix the channel audio signal having 7.1 channel to 5.1 channel.

Particularly, when down-mixing the channel audio signal, the channel rendering unit 140 may determine an object where a geometry of the channel audio signal is stopped without any change, and perform down-mixing. Also, when down-mixing a 3D channel audio signal to a 2D signal, the channel rendering unit 140 may remove an elevation component of the channel audio signal to two-dimensionally down-mix the channel audio signal or to three-dimensionally down-mix the channel audio signal so as to have a sense of virtual elevation, as described above with reference to FIG. 6. Furthermore, the channel rendering unit 140 may down-mix all signals except a front left channel, a front right channel, and a center channel that constitute a front audio signal, thereby implementing a signal with a right surround channel and a left surround channel. Also, the channel rendering unit 140 may perform down-mixing by using a multi-channel down-mix equation.

Moreover, when the number of channels of the channel audio signal is less than the number of channels of the speaker layout of the audio providing apparatus 100, the channel rendering unit 140 may up-mix the channel audio signal to perform rendering. For example, when a channel of the channel audio signal is 7.1 channel and the speaker layout of the audio providing apparatus 100 is 9.1 channel, the channel rendering unit 140 may up-mix the channel audio signal having 7.1 channel to 9.1 channel.

Particularly, when up-mixing a 2D channel audio signal to a 3D signal, the channel rendering unit 140 may generate a top layer having an elevation component, based on a correlation between a front channel and a surround channel to perform up-mixing, or divide channels into a center channel and an ambience channel through analysis of the channels to perform up-mixing.

Moreover, the channel rendering unit 140 may calculate a phase difference between a plurality of audio signals having a correlation in an operation of rendering the channel audio signal having the first channel number to the channel audio signal having the second channel number, and move one of the plurality of audio signals by the calculated phase difference to combine the plurality of audio signals.

At least one of the object audio signal and the channel audio signal having the first channel number may include guide information for determining whether to perform virtual 3D rendering or 2D rendering on a specific frame. Therefore, each of the object rendering unit 130 and the channel rendering unit 140 may perform rendering based on the guide information included in the object audio signal and the channel audio signal. For example, when guide information that allows virtual 3D rendering to be performed on an object audio signal in a first frame is included in the object audio signal, the object rendering unit 130 and the channel rendering unit 140 may perform virtual 3D rendering on the object audio signal and a channel audio signal in the first frame. Also, when guide information that allows 2D rendering to be performed on an object audio signal in a second frame is included in the object audio signal, the object rendering unit 130 and the channel rendering unit 140 may perform 2D rendering on the object audio signal and a channel audio signal in the second frame.

The mixing unit 150 may mix the object audio signal, which is output from the object rendering unit 130, with the channel audio signal having the second channel number, which is output from the channel rendering unit 140.

Moreover, the mixing unit 150 may calculate a phase difference between a plurality of audio signals having a correlation while mixing the rendered object audio signal with the channel audio signal having the second channel number, and move one of the plurality of audio signals by the calculated phase difference to combine the plurality of audio signals.

The output unit 160 may output an audio signal that is output from the mixing unit 150. In this case, the output unit 160 may include a plurality of speakers. For example, the output unit 160 may be implemented with speakers such as 5.1 channel, 7.1 channel, 9.1 channel, 22.2 channel, etc. According to another exemplary embodiment, the output unit 160 may output the audio signal to an external device connected to the speakers.

Hereinafter, various exemplary embodiments will be described with reference to FIGS. 8A to 8G.

Figure 8A:
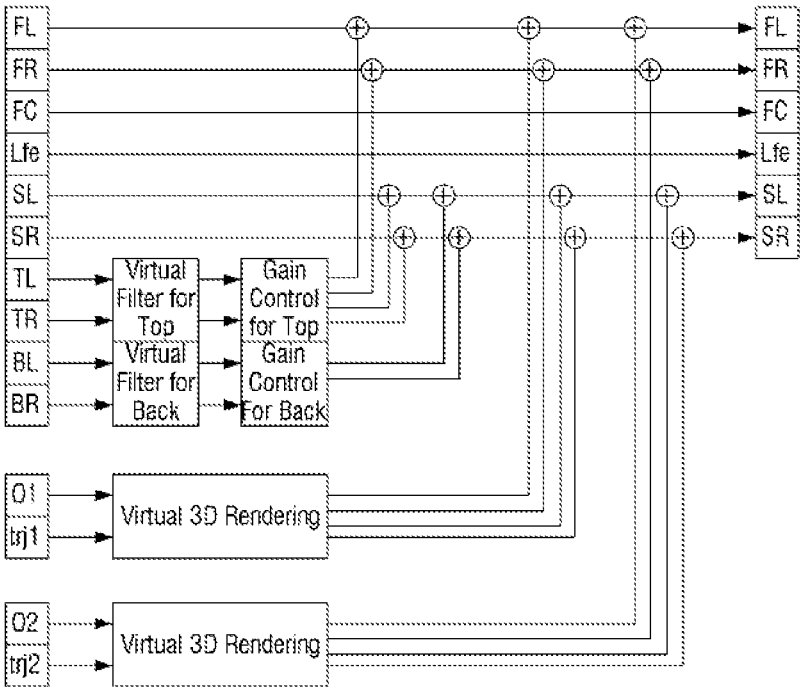
FIGS. 8A to 8G are diagrams for describing channel rendering of an audio signal according to various exemplary embodiments.

FIG. 8A is a diagram for describing rendering of an object audio signal and a channel audio signal, according to a first exemplary embodiment.

The audio providing apparatus 100 may receive a 9.1-channel channel audio signal and two object audio signals O1 and O2. In this case, the 9.1-channel channel audio signal may include a front left channel (FL), a front right channel (FR), a front center channel (FC), a subwoofer channel (Lfe), a surround left channel (SL), a surround right channel (SR), a top front left channel (TL), a top front right channel (TR), a back left channel (BL), and a back right channel (BR).

The audio providing apparatus 100 may be configured with a 5.1-channel speaker layout. That is, the audio providing apparatus 100 may include a plurality of speakers respectively corresponding to a front right channel, a front left channel, a front center channel, a subwoofer channel, a surround left channel, and a surround right channel.

The audio providing apparatus 100 may perform virtual filtering on signals respectively corresponding to the top front left channel, the top front right channel, the back left channel, and the back right channel among a plurality of input channel audio signals to perform rendering.

Moreover, the audio providing apparatus 100 may perform virtual 3D rendering on a first object audio signal O1 and a second object audio signal O2.

The audio providing apparatus 100 may mix a channel audio signal having the front left channel, a channel audio signal having the virtually-rendered top front left channel and top front right channel, a channel audio signal having the virtually-rendered back left channel and back right channel, and the virtually-rendered first object audio signal O1 and second object audio signal O2 and output a mixed signal to a speaker corresponding to the front left channel. Also, the audio providing apparatus 100 may mix a channel audio signal having the front right channel, a channel audio signal having the virtually-rendered top front left channel and top front right channel, a channel audio signal having the virtually-rendered back left channel and back right channel, and the virtually-rendered first object audio signal O1 and second object audio signal O2 and output a mixed signal to a speaker corresponding to the front right channel. Furthermore, the audio providing apparatus 100 may output a channel audio signal having the front center channel to a speaker corresponding to the front center channel and output a channel audio signal having the subwoofer channel to a speaker corresponding to the subwoofer channel. Additionally, the audio providing apparatus 100 may mix a channel audio signal having the surround left channel, a channel audio signal having the virtually-rendered top front left channel and top front right channel, a channel audio signal having the virtually-rendered back left channel and back right channel, and the virtually-rendered first object audio signal O1 and second object audio signal O2 and output a mixed signal to a speaker corresponding to the surround left channel. Moreover, the audio providing apparatus 100 may mix a channel audio signal having the surround right channel, a channel audio signal having the virtually-rendered top front left channel and top front right channel, a channel audio signal having the virtually-rendered back left channel and back right channel, and the virtually-rendered first object audio signal O1 and second object audio signal O2 and output a mixed signal to a speaker corresponding to the surround right channel.

By performing the above-described channel rendering and object rendering, the audio providing apparatus 100 may establish a 9.1-channel virtual 3D audio environment by using a 5.1-channel speaker.

Figure 8B:
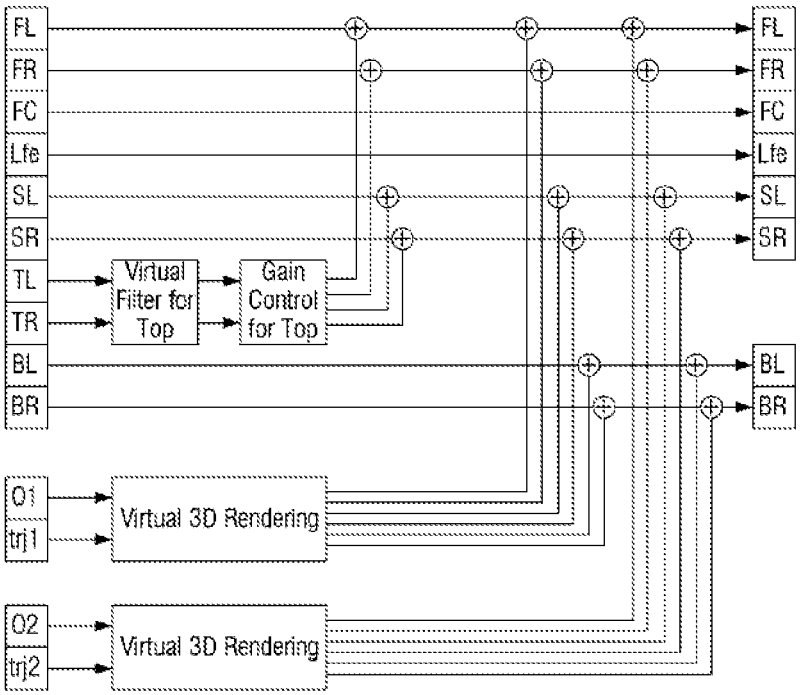

FIG. 8B is a diagram for describing rendering of an object audio signal and a channel audio signal, according to a second exemplary embodiment.

The audio providing apparatus 100 may receive a 9.1-channel channel audio signal and two object audio signals O1 and O2.

The audio providing apparatus 100 may be configured with a 7.1-channel speaker layout. That is, the audio providing apparatus 100 may include a plurality of speakers respectively corresponding to a front right channel, a front left channel, a front center channel, a subwoofer channel, a surround left channel, a surround right channel, a back left channel, and a back right channel.

The audio providing apparatus 100 may perform virtual filtering on signals respectively corresponding to the top front left channel and the top front right channel among a plurality of input channel audio signals to perform rendering.

Moreover, the audio providing apparatus 100 may perform virtual 3D rendering on a first object audio signal O1 and a second object audio signal O2.

The audio providing apparatus 100 may mix a channel audio signal having the front left channel, a channel audio signal having the virtually-rendered top front left channel and top front right channel, and the virtually-rendered first object audio signal O1 and second object audio signal O2 and output a mixed signal to a speaker corresponding to the front left channel. Also, the audio providing apparatus 100 may mix a channel audio signal having the front right channel, a channel audio signal having the virtually-rendered back left channel and back right channel, and the virtually-rendered first object audio signal O1 and second object audio signal O2 and output a mixed signal to a speaker corresponding to the front right channel. Furthermore, the audio providing apparatus 100 may output a channel audio signal having the front center channel to a speaker corresponding to the front center channel and output a channel audio signal having the subwoofer channel to a speaker corresponding to the subwoofer channel. Additionally, the audio providing apparatus 100 may mix a channel audio signal having the surround left channel, a channel audio signal having the virtually-rendered top front left channel and top front right channel, and the virtually-rendered first object audio signal O1 and second object audio signal O2 and output a mixed signal to a speaker corresponding to the surround left channel. Also, the audio providing apparatus 100 may mix a channel audio signal having the surround right channel, a channel audio signal having the virtually-rendered top front left channel and top front right channel, and the virtually-rendered first object audio signal O1 and second object audio signal O2 and output a mixed signal to a speaker corresponding to the surround right channel. Moreover, the audio providing apparatus 100 may mix a channel audio signal having the back left channel and the virtually-rendered first object audio signal O1 and second object audio signal O2 and output a mixed signal to a speaker corresponding to the back left channel. Also, the audio providing apparatus 100 may mix a channel audio signal having the back right channel and the virtually-rendered first object audio signal O1 and second object audio signal O2 and output a mixed signal to a speaker corresponding to the back right channel.

By performing the above-described channel rendering and object rendering, the audio providing apparatus 100 may establish a 9.1-channel virtual 3D audio environment by using a 7.1-channel speaker.

Figure 8C:
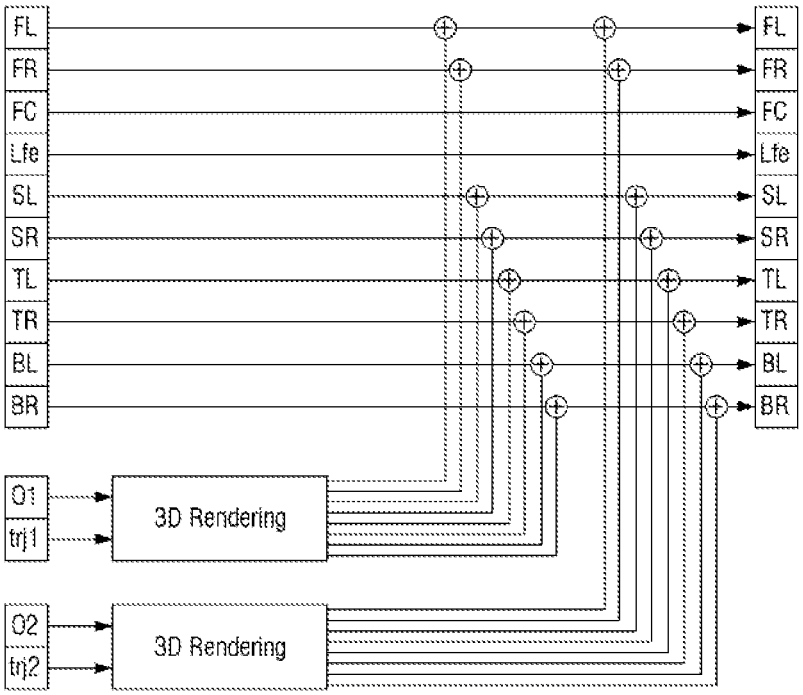

FIG. 8C is a diagram for describing rendering of an object audio signal and a channel audio signal, according to a third exemplary embodiment.

The audio providing apparatus 100 may receive a 9.1-channel channel audio signal and two object audio signals O1 and O2.

The audio providing apparatus 100 may be configured with a 9.1-channel speaker layout. That is, the audio providing apparatus 100 may include a plurality of speakers respectively corresponding to a front right channel, a front left channel, a front center channel, a subwoofer channel, a surround left channel, a surround right channel, a back left channel, a back right channel, a top front left channel, and a top front right channel.

Moreover, the audio providing apparatus 100 may perform 3D rendering on a first object audio signal O1 and a second object audio signal O2.

The audio providing apparatus 100 may mix the 3D-rendered first object audio signal O1 and second object audio signal O2 with audio signals respectively having the front right channel, the front left channel, the front center channel, the subwoofer channel, the surround left channel, the surround right channel, the back left channel, the back right channel, the top front left channel, and the top front right channel, and output a mixed signal to a corresponding speaker.

By performing the above-described channel rendering and object rendering, the audio providing apparatus 100 may output a 9.1-channel channel audio signal and a 9.1-channel object audio signal by using a 9.1-channel speaker.

Figure 8D:
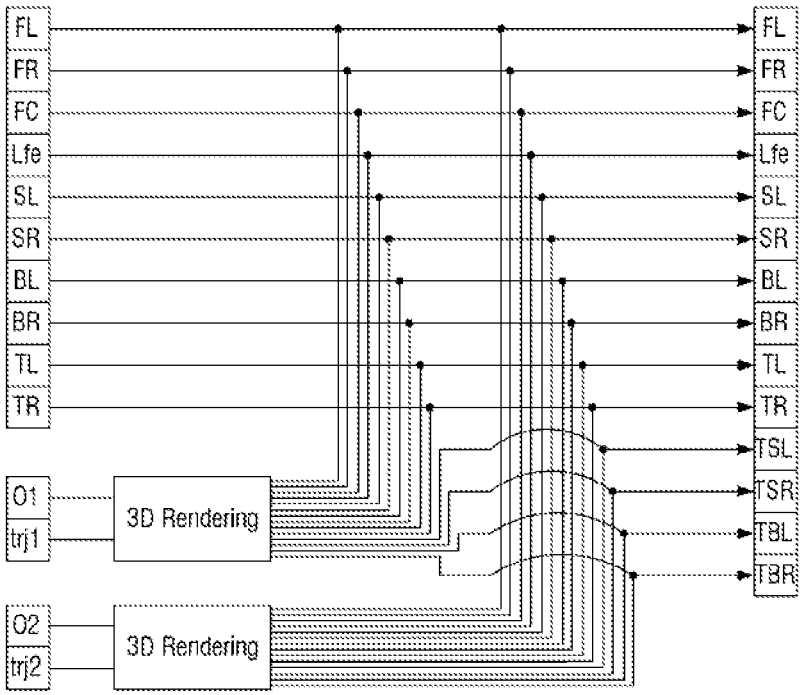

FIG. 8D is a diagram for describing rendering of an object audio signal and a channel audio signal, according to a fourth exemplary embodiment.

The audio providing apparatus 100 may receive a 9.1-channel channel audio signal and two object audio signals O1 and O2.

The audio providing apparatus 100 may be configured with an 11.1-channel speaker layout. That is, the audio providing apparatus 100 may include a plurality of speakers respectively corresponding to a front right channel, a front left channel, a front center channel, a subwoofer channel, a surround left channel, a surround right channel, a back left channel, a back right channel, a top front left channel, a top front right channel, a top surround left channel, a top surround right channel, a top back left channel, and a top back right channel.

Moreover, the audio providing apparatus 100 may perform 3D rendering on a first object audio signal O1 and a second object audio signal O2.

The audio providing apparatus 100 may mix the 3D-rendered first object audio signal O1 and second object audio signal O2 with audio signals respectively having the front right channel, the front left channel, the front center channel, the subwoofer channel, the surround left channel, the surround right channel, the back left channel, the back right channel, the top front left channel, and the top front right channel, and output a mixed signal to a corresponding speaker.

Moreover, the audio providing apparatus 100 may output the 3D-rendered first object audio signal O1 and second object audio signal O2 to a speaker corresponding to each of the top surround left channel, the top surround right channel, the top back left channel, and the top back right channel By performing the above-described channel rendering and object rendering, the audio providing apparatus 100 may output a 9.1-channel channel audio signal and a 9.1-channel object audio signal by using an 11.1-channel speaker.

Figure 8E:
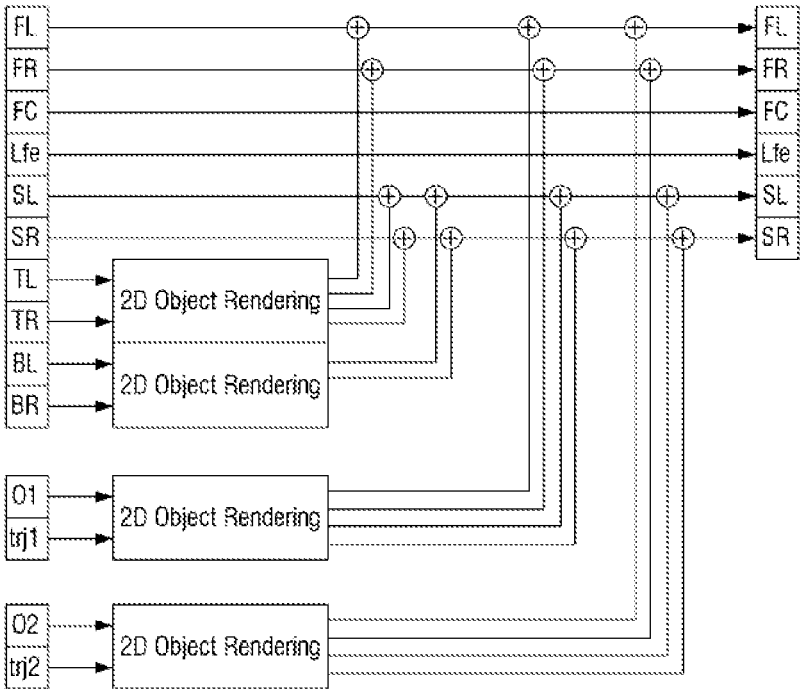

FIG. 8E is a diagram for describing rendering of an object audio signal and a channel audio signal, according to a fifth exemplary embodiment.

The audio providing apparatus 100 may receive a 9.1-channel channel audio signal and two object audio signals O1 and O2.

The audio providing apparatus 100 may be configured with a 5.1-channel speaker layout. That is, the audio providing apparatus 100 may include a plurality of speakers respectively corresponding to a front right channel, a front left channel, a front center channel, a subwoofer channel, a surround left channel, and a surround right channel.

The audio providing apparatus 100 may perform 2D rendering on signals respectively corresponding to the top front left channel, the top front right channel, the back left channel, and the back right channel among a plurality of input channel audio signals.

Moreover, the audio providing apparatus 100 may perform 2D rendering on a first object audio signal O1 and a second object audio signal O2.

The audio providing apparatus 100 may mix a channel audio signal having the front left channel, a channel audio signal having the 2D-rendered top front left channel and top front right channel, a channel audio signal having the 2D-rendered back left channel and back right channel, and the 2D-rendered first object audio signal O1 and second object audio signal O2 and output a mixed signal to a speaker corresponding to the front left channel. Also, the audio providing apparatus 100 may mix a channel audio signal having the front right channel, a channel audio signal having the 2D-rendered top front left channel and top front right channel, a channel audio signal having the 2D-rendered back left channel and back right channel, and the 2D-rendered first object audio signal O1 and second object audio signal O2 and output a mixed signal to a speaker corresponding to the front right channel. Furthermore, the audio providing apparatus 100 may output a channel audio signal having the front center channel to a speaker corresponding to the front center channel and output a channel audio signal having the subwoofer channel to a speaker corresponding to the subwoofer channel. Additionally, the audio providing apparatus 100 may mix a channel audio signal having the surround left channel, a channel audio signal having the 2D-rendered top front left channel and top front right channel, a channel audio signal having the 2D-rendered back left channel and back right channel, and the 2D-rendered first object audio signal O1 and second object audio signal O2 and output a mixed signal to a speaker corresponding to the surround left channel. Moreover, the audio providing apparatus 100 may mix a channel audio signal having the surround right channel, a channel audio signal having the 2D-rendered top front left channel and top front right channel, a channel audio signal having the 2D-rendered back left channel and back right channel, and the 2D-rendered first object audio signal O1 and second object audio signal O2 and output a mixed signal to a speaker corresponding to the surround right channel.

By performing the above-described channel rendering and object rendering, the audio providing apparatus 100 may output a 9.1-channel channel audio signal and a 9.1-channel object audio signal by using a 5.1-channel speaker. In comparison with FIG. 8A, the audio providing apparatus 100 according to the present exemplary embodiment may render a signal not into a virtual 3D audio signal but into a 2D audio signal.

Figure 8F:
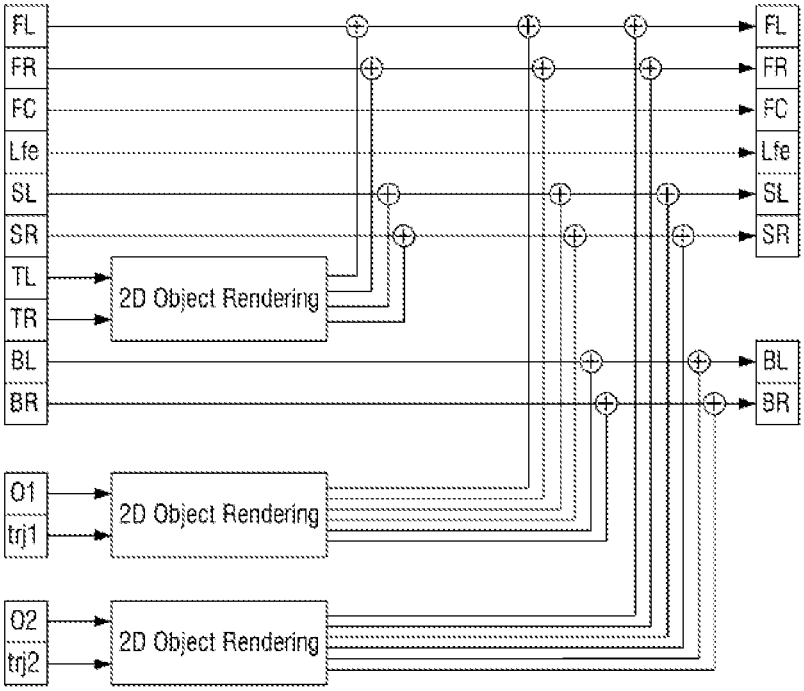

FIG. 8F is a diagram for describing rendering of an object audio signal and a channel audio signal, according to a sixth exemplary embodiment.

The audio providing apparatus 100 may receive a 9.1-channel channel audio signal and two object audio signals O1 and O2.

The audio providing apparatus 100 may be configured with a 7.1-channel speaker layout. That is, the audio providing apparatus 100 may include a plurality of speakers respectively corresponding to a front right channel, a front left channel, a front center channel, a subwoofer channel, a surround left channel, a surround right channel, a back left channel, and a back right channel.

The audio providing apparatus 100 may perform 2D rendering on signals respectively corresponding to the top front left channel and the top front right channel among a plurality of input channel audio signals.

Moreover, the audio providing apparatus 100 may perform 2D rendering on a first object audio signal O1 and a second object audio signal O2.

The audio providing apparatus 100 may mix a channel audio signal having the front left channel, a channel audio signal having the 2D-rendered top front left channel and top front right channel, and the 2D-rendered first object audio signal O1 and second object audio signal O2 and output a mixed signal to a speaker corresponding to the front left channel. Also, the audio providing apparatus 100 may mix a channel audio signal having the front right channel, a channel audio signal having the 2D-rendered back left channel and back right channel, and the 2D-rendered first object audio signal O1 and second object audio signal O2 and output a mixed signal to a speaker corresponding to the front right channel. Furthermore, the audio providing apparatus 100 may output a channel audio signal having the front center channel to a speaker corresponding to the front center channel and output a channel audio signal having the subwoofer channel to a speaker corresponding to the subwoofer channel. Additionally, the audio providing apparatus 100 may mix a channel audio signal having the surround left channel, a channel audio signal having the 2D-rendered top front left channel and top front right channel, and the 2D-rendered first object audio signal O1 and second object audio signal O2 and output a mixed signal to a speaker corresponding to the surround left channel. Moreover, the audio providing apparatus 100 may mix a channel audio signal having the surround right channel, a channel audio signal having the 2D-rendered top front left channel and top front right channel, and the 2D-rendered first object audio signal O1 and second object audio signal O2 and output a mixed signal to a speaker corresponding to the surround right channel. Also, the audio providing apparatus 100 may mix a channel audio signal having the back left channel and the 2D-rendered first object audio signal O1 and second object audio signal O2 and output a mixed signal to a speaker corresponding to the back left channel. Furthermore, the audio providing apparatus 100 may mix a channel audio signal having the back right channel and the 2D-rendered first object audio signal O1 and second object audio signal O2 and output a mixed signal to a speaker corresponding to the back right channel.

By performing the above-described channel rendering and object rendering, the audio providing apparatus 100 may output a 9.1-channel channel audio signal and a 9.1-channel object audio signal by using a 7.1-channel speaker. In comparison with FIG. 8B, the audio providing apparatus 100 according to the present exemplary embodiment may render a signal not into a virtual 3D audio signal but into a 2D audio signal.

Figure 8G:
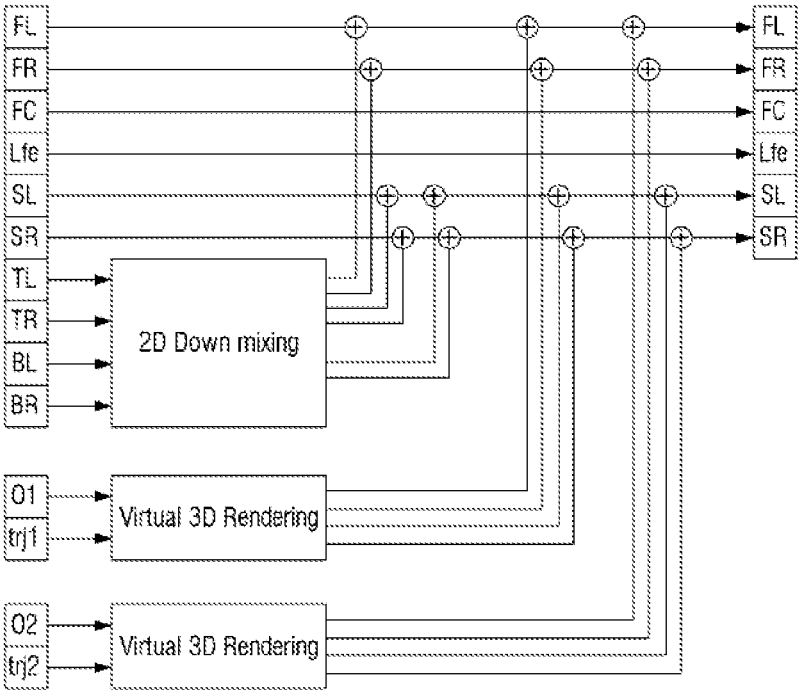

FIG. 8G is a diagram for describing rendering of an object audio signal and a channel audio signal, according to a seventh exemplary embodiment.

First, the audio providing apparatus 100 may receive a 9.1-channel channel audio signal and two object audio signals O1 and O2.

The audio providing apparatus 100 may be configured with a 5.1-channel speaker layout. That is, the audio providing apparatus 100 may include a plurality of speakers respectively corresponding to a front right channel, a front left channel, a front center channel, a subwoofer channel, a surround left channel, and a surround right channel.

The audio providing apparatus 100 may two-dimensionally down-mix signals respectively corresponding to the top front left channel, the top front right channel, the back left channel, and the back right channel among a plurality of input channel audio signals to perform rendering.

Moreover, the audio providing apparatus 100 may perform virtual 3D rendering on a first object audio signal O1 and a second object audio signal O2.

The audio providing apparatus 100 may mix a channel audio signal having the front left channel, a channel audio signal having the 2D-rendered top front left channel and top front right channel, a channel audio signal having the 2D-rendered back left channel and back right channel, and the 2D-rendered first object audio signal O1 and second object audio signal O2 and output a mixed signal to a speaker corresponding to the front left channel. Also, the audio providing apparatus 100 may mix a channel audio signal having the front right channel, a channel audio signal having the 2D-rendered top front left channel and top front right channel, a channel audio signal having the 2D-rendered back left channel and back right channel, and the 2D-rendered first object audio signal O1 and second object audio signal O2 and output a mixed signal to a speaker corresponding to the front right channel. Furthermore, the audio providing apparatus 100 may output a channel audio signal having the front center channel to a speaker corresponding to the front center channel and output a channel audio signal having the subwoofer channel to a speaker corresponding to the subwoofer channel. Additionally, the audio providing apparatus 100 may mix a channel audio signal having the surround left channel, a channel audio signal having the 2D-rendered top front left channel and top front right channel, a channel audio signal having the 2D-rendered back left channel and back right channel, and the 2D-rendered first object audio signal O1 and second object audio signal O2 and output a mixed signal to a speaker corresponding to the surround left channel. Moreover, the audio providing apparatus 100 may mix a channel audio signal having the surround right channel, a channel audio signal having the 2D-rendered top front left channel and top front right channel, a channel audio signal having the 2D-rendered back left channel and back right channel, and the 2D-rendered first object audio signal O1 and second object audio signal O2 and output a mixed signal to a speaker corresponding to the surround right channel.

By performing the above-described channel rendering and object rendering, the audio providing apparatus 100 may output a 9.1-channel channel audio signal and a 9.1-channel object audio signal by using a 5.1-channel speaker. In comparison with FIG. 8A, when it is determined that sound quality is more important than a sound image of a channel audio signal, the audio providing apparatus 100 according to the present exemplary embodiment may down-mix only a channel audio signal to a 2D signal and render an object audio signal into a virtual 3D signal.

Figure 9:
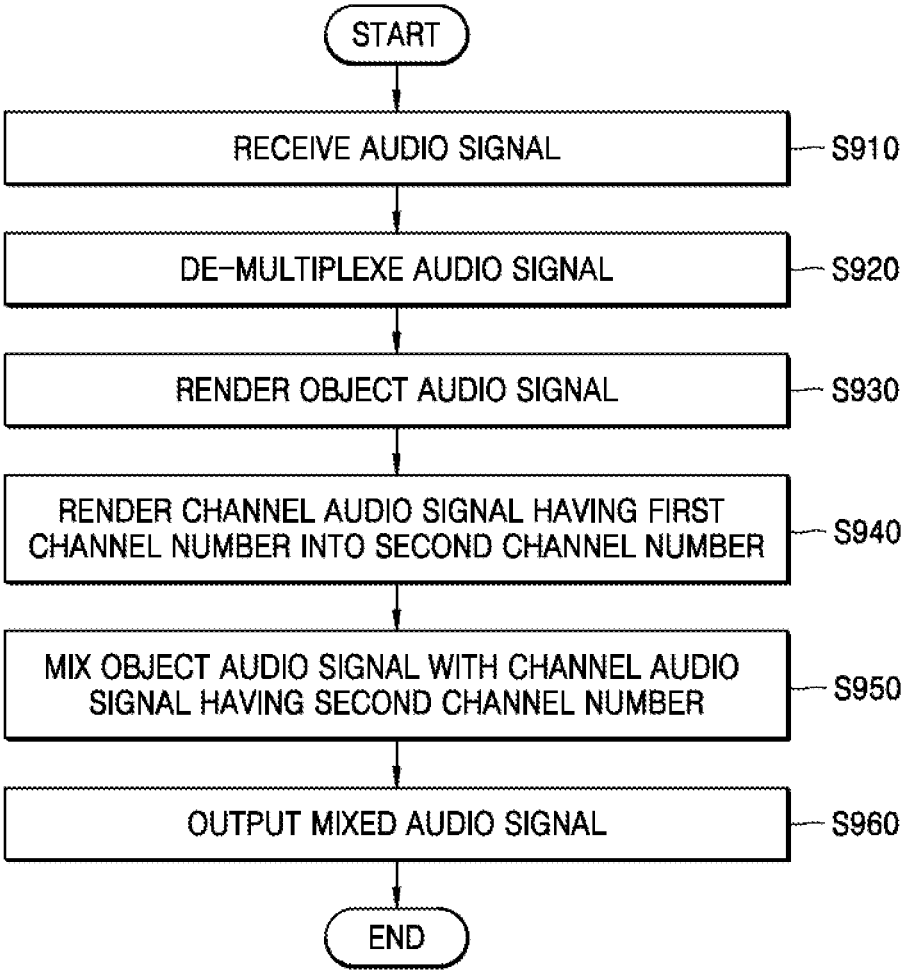
FIG. 9 is a flowchart for describing an audio signal providing method according to an exemplary embodiment.

FIG. 9 is a flowchart for describing an audio signal providing method according to an exemplary embodiment.

Referring to FIG. 9, the audio providing apparatus 100 receives an audio signal in operation S910. In this case, the audio signal may include a channel audio signal having a first channel number and an object audio signal.

In operation S920, the audio providing apparatus 100 separates the received audio signal. In detail, the audio providing apparatus 100 may de-multiplex the received audio signal into the channel audio signal and the object audio signal.

In operation S930, the audio providing apparatus 100 renders the object audio signal. In detail, as described above with reference to FIGS. 2 to 4 and 5A and 5B, the audio providing apparatus 100 may two-dimensionally or three-dimensionally render the object audio signal. Also, as described above with reference to FIGS. 6 and 7A and 7B, the audio providing apparatus 100 may render the object audio signal into a virtual 3D audio signal.

In operation S940, the audio providing apparatus 100 renders the channel audio signal having the first channel number into a second channel number. In this case, the audio providing apparatus 100 may down-mix or up-mix the received channel audio signal to perform rendering. Furthermore, the audio providing apparatus 100 may perform rendering while maintaining the number of channels of the received channel audio signal.

In operation S950, the audio providing apparatus 100 mixes the rendered object audio signal with a channel audio signal having the second channel number. In detail, as illustrated in FIGS. 8A to 8G, the audio providing apparatus 100 may mix the rendered object audio signal with the channel audio signal.

In operation S960, the audio providing apparatus 100 outputs a mixed audio signal.

According to the above-described audio providing method, the audio providing apparatus 100 reproduces audio signals having various formats to be optimal for an audio system space.

Figure 10:
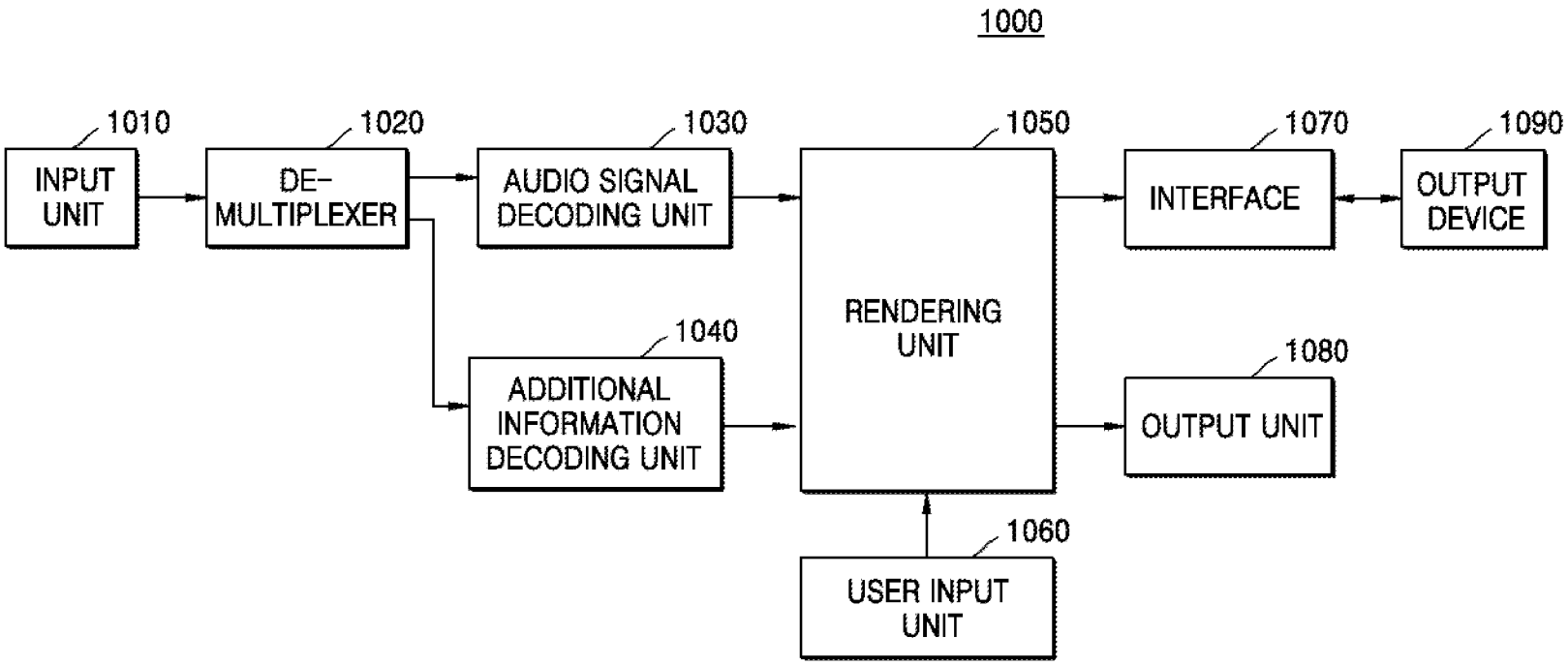
FIG. 10 is a block diagram illustrating a configuration of an audio providing apparatus according to another exemplary embodiment.

Hereinafter, another exemplary embodiment will be described with reference to FIG. 10. FIG. 10 is a block diagram illustrating a configuration of an audio providing apparatus 1000 according to another exemplary embodiment. As illustrated in FIG. 10, the audio providing apparatus 1000 includes an input unit 1010 (e.g., inputter or input device), a de-multiplexer 1020, an audio signal decoding unit 1030 (e.g., audio signal decoder), an additional information decoding unit 1040 (e.g., additional information decoder), a rendering unit 1050 (e.g., renderer), a user input unit 1060 (e.g., user inputter or user input device), an interface 1070, and an output unit 1080 (e.g., outputter or output device).

The input unit 1010 receives a compressed audio signal. In this case, the compressed audio signal may include additional information as well as a compressed-type audio signal which includes a channel audio signal and an object audio signal.

The de-multiplexer 1020 may separate the compressed audio signal into the audio signal and the additional information, output the audio signal to the audio signal decoding unit 1030, and output the additional information to the additional information decoding unit 1040.

The audio signal decoding unit 1030 decompresses the compressed-type audio signal and outputs the decompressed audio signal to the rendering unit 1050. The audio signal includes a multi-channel channel audio signal and an object audio signal. In this case, the multi-channel channel audio signal may be an audio signal such as background sound and background music, and the object audio signal may be an audio signal, such as voice, gunfire, etc., for a specific object.

The additional information decoding unit 1040 decodes additional information regarding the received audio signal. In this case, the additional information regarding the received audio signal may include various pieces of information such as at least one of the number of channels, a length, a gain value, a panning gain, a position, and an angle of the received audio signal.

The rendering unit 1050 may perform rendering based on the received additional information and audio signal. In this case, the rendering unit 1050 may perform rendering according to a user command input to the user input unit 1060 by using various methods described above with reference to FIGS. 2 to 4, 5A and 5B, 6, 7A and 7B, and 8A to 8G. For example, when the received audio signal is a 7.1-channel audio signal and a speaker layout of the audio providing apparatus 1000 is 5.1 channel, the rendering unit 1050 may down-mix the 7.1-channel audio signal to a 2D 5.1-channel audio signal and down-mix the 7.1-channel audio signal to a 3D 5.1-channel audio signal according to the user command which is input through the user input unit 1060. Also, the rendering unit 1050 may render the channel audio signal into a 2D signal and render the object audio signal into a virtual 3D signal according to the user command which is input through the user input unit 1060.

Moreover, the rendering unit 1050 may directly output the rendered audio signal through the output unit 1080 according to the user command and the speaker layout, or may transmit the audio signal and the additional information to an external device 1090 through the interface 1070. In particular, when the audio providing apparatus 1000 has a speaker layout exceeding 7.1 channel, the rendering unit 1050 may transmit at least one of the audio signal and the additional information to the external device through the interface 1070. In this case, the interface 1070 may be implemented as a digital interface such as an HDMI interface or the like. The external device 1090 may perform rendering by using the received audio signal and additional information and output a rendered audio signal.

However, as described above, the rendering unit 1050 transmitting the audio signal and the additional information to the external device 1090 is merely an exemplary embodiment. The rendering unit 1050 may render the audio signal by using the audio signal and the additional information and output the rendered audio signal.

The object audio signal according to an exemplary embodiment may include metadata including at least one of an identification (ID), type information, and priority information. For example, the object audio signal may include information indicating whether a type of the object audio signal is dialogue or commentary. Also, when the audio signal is a broadcast audio signal, the object audio signal may include information indicating whether a type of the object audio signal is a first anchor, a second anchor, a first caster, a second caster, or background sound. Furthermore, when the audio signal is a music audio signal, the object audio signal may include information indicating whether a type of the object audio signal is a first vocalist, a second vocalist, a first instrument sound, or a second instrument sound. Additionally, when the audio signal is a game audio signal, the object audio signal may include information indicating whether a type of the object audio signal is a first sound effect or a second sound effect.

The rendering unit 1050 may analyze the metadata included in the above-described object audio signal and render the object audio signal according to a priority of the object audio signal.

Moreover, the rendering unit 1050 may remove a specific object audio signal according to a user's selection. For example, when the audio signal is an audio signal for sports, the audio providing apparatus 1000 may display a user interface (UI) that shows a type of a currently input object audio signal to the user. In this case, the object audio signal may include a caster's voice, voiceover, shouting voice, etc. When a user command for removing a caster's voice from among a plurality of object audio signals is input through the user input unit 1060, the rendering unit 1050 may remove the caster's voice from among the plurality of object audio signals and perform rendering by using the other object audio signals.

Moreover, the rendering unit 1050 may raise or lower volume for a specific object audio signal according to a user's selection. For example, when the audio signal is an audio signal included in movie content, the audio providing apparatus 1000 may display a UI that shows a type of a currently input object audio signal to the user. In this case, the object audio signal may include a first protagonist's voice, a second protagonist's voice, a bomb sound, airplane sound, etc. When a user command for raising the volume of the first protagonist's voice and the second protagonist's voice and lowering the volume of the bomb sound and the airplane sound among a plurality of object audio signals is input through the user input unit 1060, the rendering unit 1050 may raise the volume of the first protagonist's voice and the second protagonist's voice and lower the volume of the bomb sound and the airplane sound.

According to the above-described exemplary embodiments, a user manipulates a desired audio signal, and thus, an audio environment that is suitable for the user is established.

The audio providing method according to various exemplary embodiments may be implemented as a program and may be provided to a display apparatus, a processing apparatus, or an input apparatus. Particularly, a program including a method of controlling a display apparatus may be stored in a non-transitory computer-readable recording medium and provided.

The non-transitory computer-readable recording medium denotes a medium that semi-permanently stores data and is readable by a device, instead of a medium that stores data for a short time like registers, caches, and a memories. In detail, various applications or programs may be stored in a non-transitory computer-readable recording medium such as a CD, a DVD, a hard disk, a blue-ray disk, a USB memory, a memory card, or ROM. Furthermore, it is understood that one or more of the components, elements, units, etc., of the above-described apparatuses may be implemented in at least one hardware processor.

While exemplary embodiments have been particularly shown and described above, it will be understood that various changes in form and details may be made therein without departing from the spirit and scope of the following claims.

What is claimed is:

1. An audio providing apparatus comprising:

a receiver configured to receive a plurality of input channel signals; and a renderer configured to align a difference in phase between correlated input channel signals among the plurality of input channel signals, and downmix the plurality of input channel signals including the correlated input channel signals into a plurality of output channel signals based on an input layout and an output layout, and wherein the input layout is a format of the plurality of input channel signals and the output layout is a format of the plurality of output channel signals.

2. The apparatus of claim 1, wherein the output layout is 5.1 channel layout.

3. The apparatus of claim 1, wherein the receiver is configured to receive information for determining whether to perform virtual 3D rendering on a specific frame.

* * * * *